US007178368B2

(12) United States Patent
Durazzani

(10) Patent No.: US 7,178,368 B2
(45) Date of Patent: Feb. 20, 2007

(54) ROTATING-DRUM WASHING MACHINE

(75) Inventor: Piero Durazzani, Porcia (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 15 days.

(21) Appl. No.: 10/476,831

(22) PCT Filed: May 21, 2002

(86) PCT No.: PCT/EP02/05541

§ 371 (c)(1),
(2), (4) Date: Jul. 12, 2004

(87) PCT Pub. No.: WO02/101136

PCT Pub. Date: Dec. 19, 2002

(65) Prior Publication Data

US 2004/0244440 A1 Dec. 9, 2004

(30) Foreign Application Priority Data

Jun. 11, 2001 (IT) ..... PN2001A0042

(51) Int. Cl.
*D06F 37/02* (2006.01)

(52) U.S. Cl. ..... 68/24; 68/58; 68/140

(58) Field of Classification Search ..... 68/142, 68/24, 58, 140
See application file for complete search history.

(56) References Cited

U.S. PATENT DOCUMENTS

| | | | | |
|---|---|---|---|---|
| 8,159 | A * | 6/1851 | Horney | 101/28 |
| 32,469 | A * | 6/1861 | Collier | 68/142 |
| 50,464 | A * | 10/1865 | Ghormley | 68/30 |
| 104,708 | A * | 6/1870 | Cottingram | 68/16 |
| 111,906 | A * | 2/1871 | Carman et al. | 68/29 |
| 127,129 | A * | 5/1872 | Gould | 188/80 |
| 174,747 | A * | 3/1876 | Tarr | 68/142 |
| 2,516,656 | A * | 7/1950 | Smith | 68/131 |
| 2,575,691 | A * | 11/1951 | Smith | 68/23.7 |
| 2,630,001 | A * | 3/1953 | Criner | 68/23.5 |
| 3,416,334 | A | 12/1968 | Candor et al. | |
| 4,156,358 | A * | 5/1979 | Harrsch | 68/27 |
| 4,742,698 | A * | 5/1988 | Torita | 68/12.04 |
| 4,837,883 | A | 6/1989 | Ishida et al. | |
| 6,281,790 | B1 * | 8/2001 | Kimmel et al. | 340/506 |
| 6,843,079 | B2 * | 1/2005 | Hird | 68/13 R |

FOREIGN PATENT DOCUMENTS

| | | | |
|---|---|---|---|
| WO | 99/58753 | A | 11/1999 |

* cited by examiner

*Primary Examiner*—Frankie L. Stinson
(74) *Attorney, Agent, or Firm*—Pearne & Gordon LLP

(57) ABSTRACT

The washing machine comprises a rotating drum (4) formed by two complementary portions, a first one (6) of which is connected to driving means (10, 11), while the other one (7) is rotatably free with respect to the first one (6), by which it is driven rotatably due to the effect of the movement induced by the clothes that are agitated when said first portion (6) of the drum is rotating.

6 Claims, 1 Drawing Sheet

ROTATING-DRUM WASHING MACHINE

Figure 1:
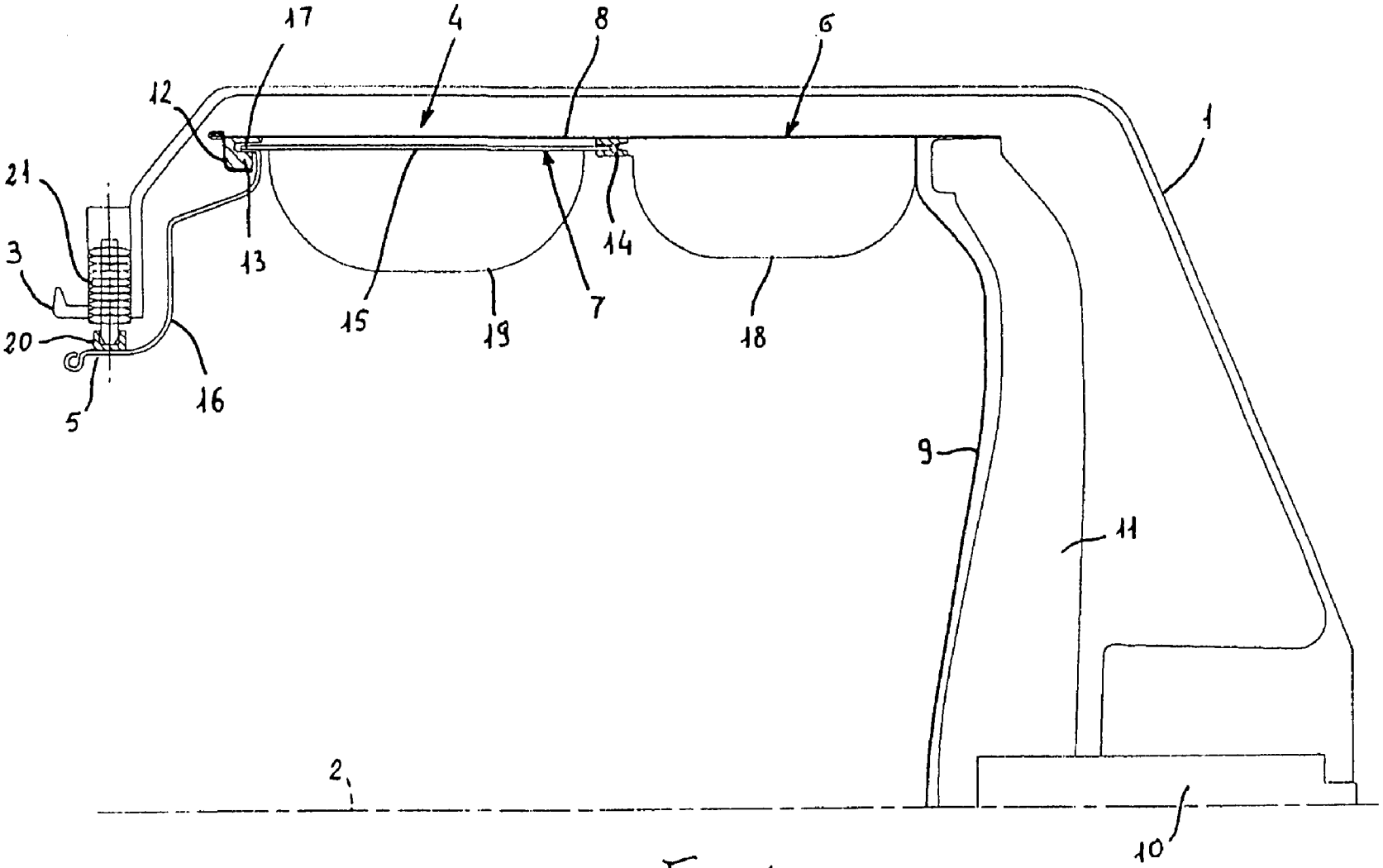

This application claims the benefit of International Application Number PCT/EP02/05541, which was published in English on Dec. 19, 2002.

The present invention refers to a washing machine, such as a clothes washing machine or a combined clothes washing and drying machine, of the type comprising a washing tub accommodating a rotating drum adapted to hold and agitate the clothes (or even other items) to be washed.

In view of boosting the mechanical washing effect on the clothes, a solution has been proposed in WO 99/58753 which calls for the rotating drum to be made up by at least two juxtaposed complementary portions that are capable of being caused to rotate in opposite directions by means of respective driving means, each one of which comprising a motor with associated motion-transmission devices.

Such a solution appears to be undesirably complex, expensive and bulky, i.e. space-demanding, as well as scarcely reliable, owing to the considerable number of additional component parts that are required in order to be able to drive the drum in a differentiated manner.

Furthermore, the rotation in mutually opposite directions of the two portions of the drum is quite likely to expose the clothes to a definitely excessive mechanical action, under resulting marked wear and tear problems.

It therefore is a main purpose of the present invention to provide a rotating-drum washing machine capable of exerting on the clothes an advantageously intensified mechanical action in an adequate manner, while using a particularly simple, reliable and low-cost structure to such a purpose.

In particular, it is a purpose of the present invention to provide a washing machine of the above cited kind, which can allow for the use of simple, traditional drum driving means.

According to the present invention, these and further aims are reached in a rotating-drum washing machine embodying the characteristics as recited and defined in the appended claims.

Anyway, features and advantages of the present invention may be more readily understood from the description that is given below by way of non-limiting example with reference to the single accompanying drawing, which is a schematic, partially cross-sectional view of the main mechanical component parts of the machine according to a preferred embodiment of the present invention.

The washing machine may be a automatic clothes washing machine, or a combined clothes washing and drying machine, comprising an outer casing which houses an oscillating assembly that is suspended to the framework of the machine through vibration-damping struts or similar means.

With reference to the above-mentioned FIGURE, the oscillating assembly comprises mainly a washing tub 1, preferably in a substantially cylindrical shape with a substantially horizontal axis 2.

In a per sé known manner, the tub 1 comprises a flanged front aperture 3 and houses in its interior a rotating drum 4, into which the clothes to be washed can be loaded through a flanged front aperture 5 that is substantially aligned axially with the aperture 3 of the tub.

The drum 4 may be made of metal and/or plastic material. In all cases, it comprises at least a first and a second portion 6 and 7, which are complementary and preferably coaxial with each other.

The second portion 7 of the drum is substantially rotatably free, about its own axis (which may coincide with the axis 2 of the tub), with respect to the first portion 6, by which it is driven rotatably due to the effect of the movement induced by the clothes that are agitated when said first portion 6 of the drum is rotating.

In particular, the first portion 6 of the drum 4 comprises a perforated peripheral cylindrically shaped wall 8 and a back wall 9, and it is adapted to be rotatably driven, about the axis 2, by simple driving means that may be of the traditional kind comprising a drive shaft 10 connected to the portion 6 of the drum by means of a spider 11 or similar member.

In a preferred manner the cylindrical side wall 8 of the portion 6 extends over almost the whole axial length of the drum and is provided, on the side thereof facing the loading aperture 5, with a properly shaped rim 12 carrying at least a circumferential slide runner 13 that may be conformed in a ring-like shape, i.e. into a closed loop, with a substantially C-shaped cross-section.

In an axially intermediate position, and preferably on its inner surface, the cylindrical side wall 8 carries at least a further circumferential slide runner 14 that may be similarly conformed to a ring-like shape, i.e. into a closed loop, with a cross-section that is similar to and opposing the one of said slide runner 13.

Said circumferential slide runners 13 and 14 are preferably made of a material having a low coefficient of friction, such as for instance Teflon or the like.

The second portion 7 of the drum comprises in turn a cylindrical side wall 15 (which may be perforated) and a properly shaped front wall 16 defining the loading aperture 5.

In particular, the cylindrical side wall 15 of said portion 7 of the drum comprises, on a side thereof, an annular flange 17 that is coupled to the slide runner 13, whereas, on the other side thereof, the annular rim of said cylindrical side wall 15 is coupled to the slide runner 14.

When the shaft 10 rotatably drives the portion 6 of the drum 4, the complementary portion 7 tends to remain still, i.e. motionless initially, when it practically slides with respect to the runners 13 and 14. Subsequently, however, the movement of the clothes being agitated by the portion 6 of the drum tends to impart a rotatably driving effect also to the complementary portion 7, which therefore starts to rotate at an gradually increasing speed which may ultimately even equal the rotating speed of the portion 6 itself. This is particularly important during spin-extraction phases, in which the clothes are spin-dried at quite high revolution speeds (for example, in the order of 600 to 1000 rpm), in order to avoid exposing the clothes to excessive mechanical stresses.

Such a rotatably driving effect exerted by the portion 6 of the drum on the complementary portion 7 may be boosted by providing each such portion 6, 7 with respective internal entrainment ribs 18, 19 that contribute to enhance the mechanical connection, via the clothes themselves, between the same portions 6 and of the rotating drum 4.

The above cited rotatably driving effect may be brought about, or even boosted, also by taking advantage of the friction occurring between the slide runners 13, 14 and the cylindrical side wall 15. In this connection, all those skilled in the art will be able to readily understand that such a rotatably driving effect can be varied according to the requirements by appropriately sizing the component parts involved and/or through an appropriate selection of materials.

In all cases, the mechanical washing action that is imparted by the drum 4 on to the clothes is advantageously carried out in an adequately enhanced manner by said complementary portions 6 and 7 of the drum rotating at substantially different speeds, but never in mutually opposite directions.

In a preferred manner, in view of enhancing the mechanical washing action on the clothes when the drum 4 is rotating at a low washing speed (e.g., approx. 50 rpm), there is provided a locking or braking shoe 20, or the like, which is normally in an idle condition and adapted to be actuated selectively, for instance by means of an electromagnet 21 mounted on the tub 1, in order to prevent the portion 7 of the drum from rotating. Under the circumstances, therefore, the clothes will be washed by the sole rotation of the portion 6 of the drum.

Analogous means as the above described arrangement 20, 21 may be further provided in view of rotatably coupling the two complementary portions 6 and 7 of the drum with each other during spin-extraction, i.e. when the clothes are spin-dried at high speed, so that such spin-extraction phases will be able to be performed in a substantially traditional manner, with both portions 6 and 7 of the drum rotating jointly at a same high revolution speed.

It shall be appreciated that the above described washing machine may be the subject of a number of modifications without departing from the scope of the present invention.

For instance, the sliding coupling of said complementary portions 6 and 7 of the rotating drum 4 with each other may be brought about in any different manner, e.g. by providing the slide runners 13, 14 on the portion 7, rather than the portion 6 of the drum.

Furthermore, said slide runners 13, 14 may be formed each by several circular segments, as distributed circumferentially in an appropriate manner, rather than by respective annular structures.

Also, the portion 7 of the drum may be adapted to partially accommodate the complementary portion 6 in its interior, rather than the afore described other way round.

It will be also appreciated that the washing machine according to the present invention may be of the type provided with a drum rotating about an inclined or vertical axis, rather than a horizontal one.

The invention claimed is:

1. Washing machine with a washing tub in which there is housed a drum adapted to hold clothes, or any other possible items, to be washed, said drum comprising a first portion rotatably driven by driving means to rotate about a rotational axis, and a second complementary portion adapted to contain items to be washed, wherein the second complementary portion is permanently disengaged from said driving means and is adapted to be entrained into rotating coaxially with said first portion solely due to the effect of the movement induced by the clothes that are agitated when said first portion of the drum is rotating.

2. Washing machine according to claim 1, wherein said complementary portions of the drum are coupled with each other through at least a slide runner.

3. Washing machine according to claim 2, wherein said complementary portions of the drum are coupled with each other in a manner involving just a low friction.

4. Washing machine according to claim 1, wherein said portions of the rotating drum (4) comprise respective internal entrainment ribs.

5. Washing machine comprising:

a washing tub in which there is housed a drum adapted to hold clothes, or any other possible items, to be washed, said drum comprising a first portion rotatable driven by driving means and a second complementary portion permanently disengaged from said driving means and is adapted to be entrained into rotating solely due to the effect of the movement induced by the clothes that are agitated when said first portion of the drum is rotating; and a braking shoe for selectively engaging between the second portion and the washing tub so as to prevent said second portion of the drum from rotating when the first portion of the drum is driven rotatably.

6. Washing machine comprising:

a washing tub in which there is housed a drum adapted to hold clothes, or any other possible items, to be washed, said drum comprising a first portion rotatable driven by driving means and a second complementary portion permanently disengaged from said driving means and is adapted to be entrained into rotating solely due to the effect of the movement induced by the clothes that are agitated when said first portion of the drum is rotating; and a braking shoe for selectively engaging between said first portion and said second portion so as to rotatably couple said first and second complementary portions of the drum with each other.

* * * * *

UNITED STATES PATENT AND TRADEMARK OFFICE

CERTIFICATE OF CORRECTION

PATENT NO. : 7,178,368 B2
APPLICATION NO. : 10/476831
DATED : February 20, 2007
INVENTOR(S) : Durazzani It is certified that error appears in the above-identified patent and that said Letters Patent is hereby corrected as shown below:

Column 2, line 55 insert the numeral 7 after the word - and

Signed and Sealed this

Fourteenth Day of August, 2007

JON W. DUDAS
*Director of the United States Patent and Trademark Office*